United States Patent [19]

Gies et al.

[11] Patent Number: 4,864,798

[45] Date of Patent: Sep. 12, 1989

[54] CUP-FILLING APPARATUS FOR A NUTRIENT AND PALATABLE MATERIAL, ESPECIALLY A DAIRY PRODUCT

[75] Inventors: Burkhard Gies, Wuppertal; Berthold Lingenhoff, Hilden, both of Fed. Rep. of Germany

[73] Assignee: Hamba-Maschinenfabrik Hans A. Muller GmbH & Co. KG, Wuppertal, Fed. Rep. of Germany

[21] Appl. No.: 254,382

[22] Filed: Oct. 5, 1988

Related U.S. Application Data

[62] Division of Ser. No. 58,164, Jun. 4, 1987, Pat. No. 4,796,406.

[30] Foreign Application Priority Data

Jun. 10, 1986 [DE] Fed. Rep. of Germany ..... 3619519

[51] Int. Cl.[4] ..... B65B 43/40

[52] U.S. Cl. ..... 53/202; 53/253; 414/790.4

[58] Field of Search ..... 53/202, 250, 168, 282, 53/305, 308, 253, 532, 541; 414/788.8, 790.4, 795.6, 795.8

[56] References Cited

U.S. PATENT DOCUMENTS

| | | | |
|---|---|---|---|
| 2,919,830 | 1/1960 | Anderson | 221/11 |
| 3,722,741 | 3/1973 | Mojden | 221/11 |
| 3,938,697 | 2/1976 | Kinney | 414/795.8 |
| 4,298,137 | 11/1981 | Mancini | 221/11 |
| 4,537,550 | 8/1985 | Mojden | 414/790.4 |

FOREIGN PATENT DOCUMENTS

| | | | |
|---|---|---|---|
| 2728759 | 1/1979 | Fed. Rep. of Germany | 53/282 |
| 148826 | 8/1985 | Japan | 53/471 |
| 333249 | 3/1973 | United Kingdom | 53/282 |

*Primary Examiner*—John Sipos

*Attorney, Agent, or Firm*—Herbert Dubno

[57] ABSTRACT

The cup filling unit includes a guided circulating feed means which carries cup receptacles positioned in rows transverse to the feed direction. The cup receptacles also follow feed paths parallel to the feed direction. An elevator is provided for feeding cup and/or cover stacks in an added cup and/or cover feed device. The carrier of the elevator engages under a cup and/or cover stack and raises it from below axially into a lower opening of a shaft of an intermediate magazine. Each lower opening is associated with an engagable or disengagable supporting base for gripping under or delivering an overlapping cup and/or cover stack. The intermediate magazine is movable and displaceable from its filling position into a discharging position. In the discharging position the lower opening of the intermediate magazine substantially coincides with the upper opening of a cup and/or cover delivery magazine positioned above the cup and/or cover delivery station. More than one intermediate magazine is advantageously provided in the cup filling unit. Thus an easily operable substantially improved cup and/or cover feed device can be included in the cup and/or cover filling unit without expensive reconstruction.

4 Claims, 10 Drawing Sheets

CUP-FILLING APPARATUS FOR A NUTRIENT AND PALATABLE MATERIAL, ESPECIALLY A DAIRY PRODUCT

This is a divisional of co-pending application Ser. No. 058,164, filed on June 4, 1987 now U.S. Pat. No. 4,796,406.

FIELD OF THE INVENTION

Our present invention relates to a cup-filling apparatus for packaging a comestible material, especially a dairy product.

BACKGROUND OF THE INVENTION

A cup-filling unit for a comestible item, especially a dairy product, can have a circulating feed means or conveyor which carries a plurality of cup receptacles positioned in rows transverse to a feed direction of cup feed paths.

Aligned along the paths are a number of workstations, particularly a cup feed station, a cover mounting station, a closing station and a cup removing station running in temporally equal feed cycles in succession, i.e. operating in the cadence at which the conveyor is stepped.

The plurality of column-like cup and/or cover stacks along the cup feed paths can be inclined to the stack axes and simultaneously fed to the shafts of a cup and/or cover magazine.

In the known cup-filling unit, cup stacks are fed rowwise along an inclined plane to the cup feed magazines. This inclined plane is extended in front of the shafts of the cup delivery magazine and positioned on the front side of the cup-filling unit. The known cup-magazine refilling unit permits continuous automatic feed of a large number of cups which considerably operation of cup-filling apparatus at high rates of 10,000 to 20,000 cups per hour. However currently the column-like cup stack must be supplied with an ergonometrically unsatisfactory input height of about 1.8 m which makes handling difficult.

OBJECTS OF OUR INVENTION

It is an object of our invention to provide an improved cup-filling apparatus for comestible items, especially for dairy products, which obviates the drawbacks of earlier systems.

It is also an object of our invention to provide an improved cup-filling apparatus for comestible items in which the handling of the column-like cup stacks is ergonometrically satisfactory.

It is another object of our invention to provide an improved cup-filling apparatus for comestible items in which handling of the cup stacks or operation is improved and the subsequent equipping of the cup-filling apparatus with a cup and/or cover feed device as needed is facilitated.

SUMMARY OF THE INVENTION

These objects and others which will become more readily apparent hereinafter are attained in accordance with our invention in a cup-filling apparatus for a comestible item, especially a dairy product, comprising a revolving feed means which carries cup receptacles positioned in rows transverse to a feed direction, the receptacles being also aligned along cup feed paths parallel to the feed direction.

A plurality of workstations are aligned along the path including a cup-feeding station, a cover or lid mounting station, a closing station and a cup and/or cover removing station running in temporally equal feed cycles in succession. The column-like cup and/or cover stacks on the cup feed paths which are often inclined with respect to the stack axes simultaneously are fed to shafts of a cup and/or cover magazine.

According to our invention an elevator is provided for feeding the cup and/or cover stacks. A carrier of the elevator engages under at least one of the cup and/or cover stacks and lifts the cup and/or cover stack from below axially into a lower opening of one of the shafts of an intermediate one of the cup and/or cover magazines, each of the lower openings being associated with an engagable and/or disengagable supporting base for engaging under or discharging the cup and/or cover stack.

The intermediate magazine is movable and displacable from a filling position to a discharging position in which each of the lower openings registers with an upper opening of a cup and/or cover delivery magazine positioned above the cup and/or cover removing station.

Because the invention appropriately provides an elevator for feeding the cup and/or cover stacks the inclined feed plane for intermediate supply of input cup and/or cover stacks rowwise can be independent of the delivery height predetermined by the cup-filling apparatus at an ergonometrically satisfactory working height of about 1 m.

Also according to our invention the elevator feeds the cup and/or cover stacks rowwise (a row contains cup and/or cover stacks corresponding in number to the cup feed paths) from below axially into the lower shaft openings of an intermediate magazine.

As soon as the shafts of the intermediate magazine are filled, the engagable and disengagable supporting base is activated. This guarantees that the cup and/or cover stacks are discharged next from the intermediate magazine (drops out) when each lower intermediate magazine opening is aligned with an upper opening of the cup and/or cover delivery magazine which is positioned above the cup and/or cover mounting or removing station.

Thus, according to our invention, the intermediate magazine is displacable from its filling position into its discharging position which has several advantages:

The invention can provide two intermediate magazines in operation of which one is located above the delivery magazine in the discharging position while the other intermediate magazine is being filled directly. Thus the performance of the cup and/or cover feed device is augmented which is important with cup-filling apparatus having extremely high operating rates.

Moreover the fact that the intermediate magazine must be moved from its filling position into its discharging position allows a greater flexibility in regard to the spatial arrangement of the cup and cover feed to the cup-filling apparatus.

With the front feed of the cups our invention provides that an intermediate magazine is pivotable for filling from the front of the cup-filling apparatus to such an extent that practically no changes in the structure of the cup-filling apparatus are required. On the other hand according to the basic concept of our invention the cover feed (the cover mounting station is located downstream of the cup feed station and is thus difficult to take care of or operate in multipath cup-filling apparatus) is facilitated considerably.

Of course the inclined feed surface can be located on a long side of the cup-filling apparatus.

The intermediate magazine shafts are arranged in succession or in rows during the filling process parallel to the cup-filling apparatus long side after its motion from the discharging position transverse to the long side.

Both the previously described cup feed and also the previously described cover feed facilitates subsequent equipping of an already available cup-filling apparatus with our invention. Especially advantageous is the fact that the elevator with the inclined feed surface can be separated from the previously used machine design because of the motion of the intermediate magazine.

There are a variety of arrangements and structures possible within the scope of our invention. The motion of the intermediate magazine from the filling to the discharging position can occur substantially in the same plane.

Also the motion of the intermediate magazine from the filling position to said discharge position can advantageously be a linear motion or a pivotal motion of a large radius R, i.e. is approximately linear.

Furthermore the supporting base simultaneously forms a spatially holdable sliding surface for the underside of the cup and/or cover stack during motion of a filled one of the intermediate magazines from the filling to the discharging position.

Advantageously an immovable spatially fixed supporting and sliding surface engaging under the cup and/or cover stack can be provided for bridging a space between the filling position and the discharging position.

In another feature of the invention the shafts of the intermediate magazine are attached projecting laterally exteriorly to a circulating intermediate magazine chain driven about a plurality of vertical rotation axes.

Moreover the circulating intermediate magazine chain can be arranged to form a plurality of equal longitudinal peripheral portions which carry the same number of the intermediate magazine shafts as the number of the cup feed paths.

For feeding the cup and/or the cover stacks, particularly the cover stacks, the elevator with the carrier can be located on a long side of the cup-filling apparatus and the intermediate magazine can be displacable from the filling position alongside the cup-filling apparatus into the discharging position extending at right angles to the cup feed paths above the cover removing station.

For feeding the cup stacks, the elevator with the carrier can be positioned on a front side of the cup-filling apparatus and the intermediate magazine can be displaced from the filling position extending parallel to the cup receptacle rows into the discharging position parallel to and above the cup delivery magazine.

The intermediate magazine above the cup delivery magazine can be suspended pivotally with a rotation axis thereof positioned parallel to the cup receptacle rows and both the lifting axis of the elevator and the longitudinal axis of the cup stack of the cup delivery magazine are positioned at least substantially radially with respect to the rotation axis of the intermediate magazine.

At least one immovable spatially fixed supporting or sliding base can be formed by a bridging sliding surface extending along the pivot periphery located under the pivotable intermediate magazine on the pivotal course from the filling position to the discharging position.

In a double step cup-filling apparatus the intermediate magazine is provided with two intermediate magazine shaft rows which are fillable in succession by the elevator, the first one of the intermediate magazine shaft rows being associated with a special engagable one of the supporting bases and as needed an additional one of the immovable spatially fixed delivery sliding or supporting bases being provided extending along the pivot periphery.

BRIEF DESCRIPTION OF THE DRAWING

The above and other objects features and advantages of our invention will become more readily apparent from the following description, reference being made to the accompanying highly diagrammatic drawing in which.

SPECIFIC DESCRIPTION

Figure 1:
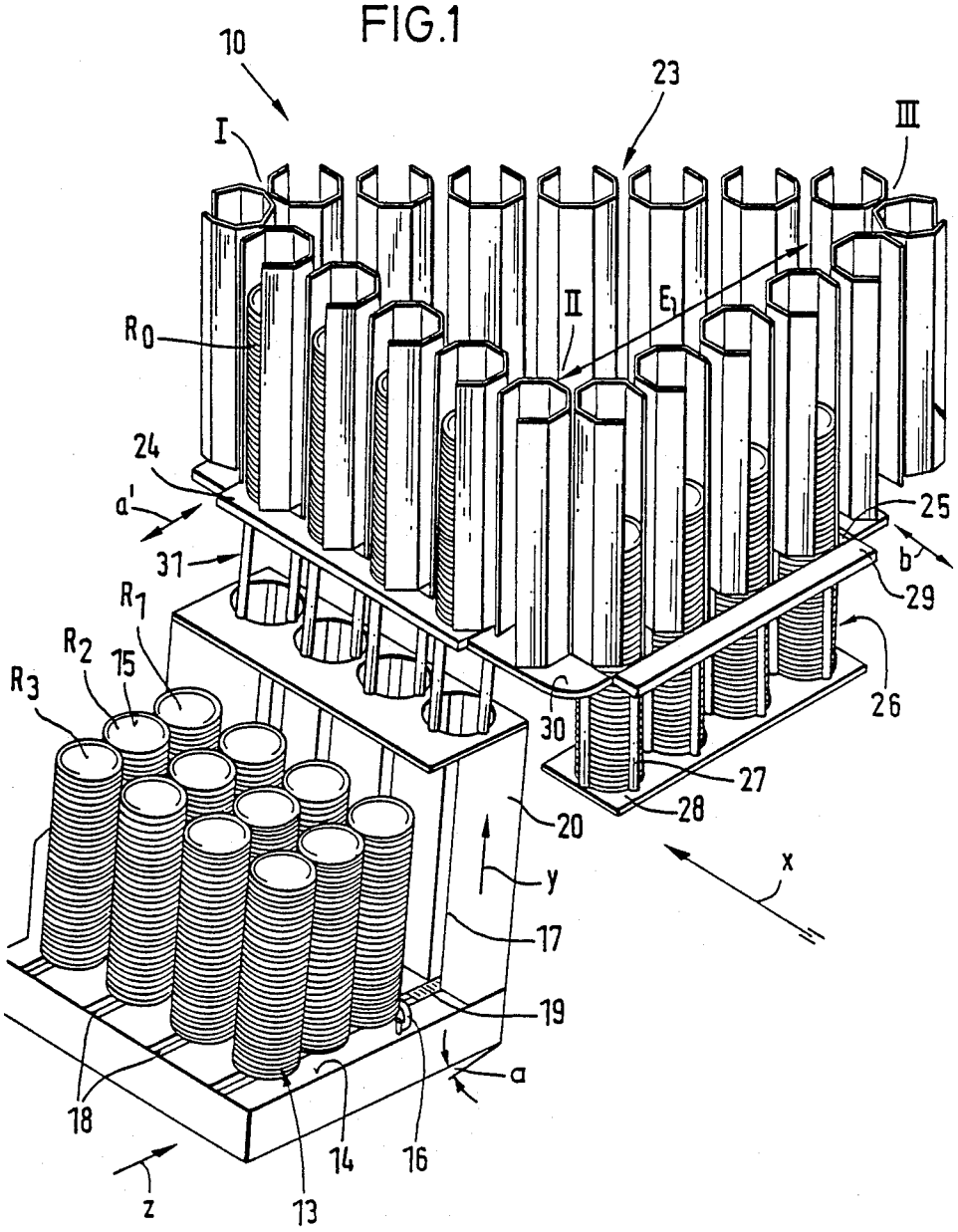
FIG. 1 is a perspective view of a cover feed device and a cover delivery magazine of the cup-filling apparatus according to our invention (shown in a first operating position)
Figure 1A:
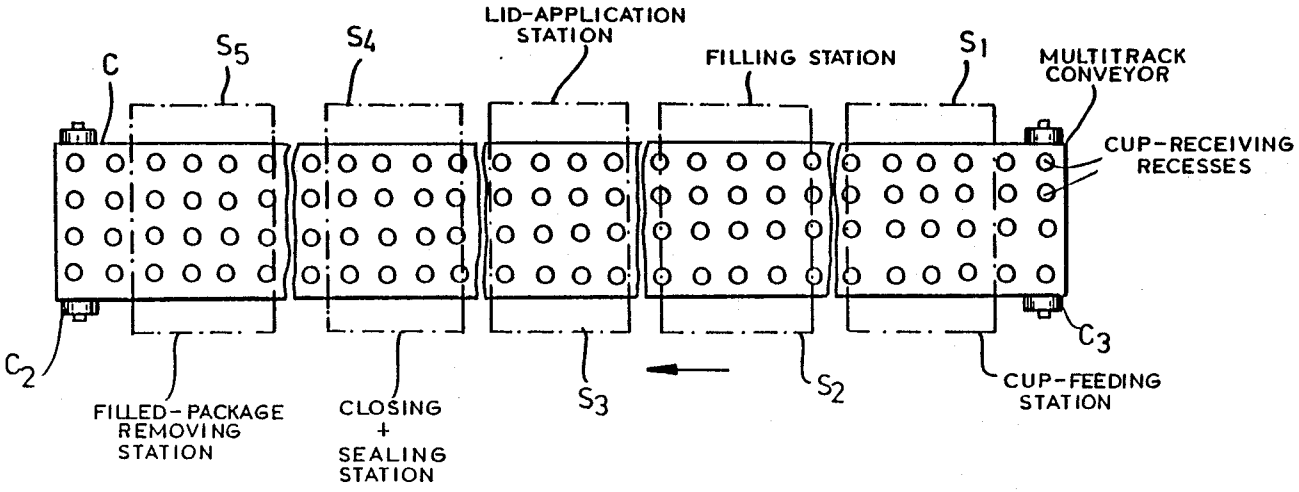
FIG. 1A is a diagrammatic plan view of the apparatus.

From FIG. 1A, it can be seen that the apparatus as a whole can comprise a conveyor C circulating over an endless path defined by rollers $C_2$ and $C_3$. The conveyor has cup-receiving recesses, pockets or receptacles C, into each of which a cup-feeding station S, along the path of the tracks or rows of recesses, inserts a respectively upwardly open cup. The cups are filled, as is conventional, at a filling station $S_2$ and, after being filled, a lid or cover is applied from a stack in a feed magazine assigned to the respective row in a lid-application station $S_3$. A closing and sealing station Sy then seals the lids on the container cups and the filled cups can be removed at a further station $S_5$, packed into cartons and stored or distributed.

The cover and cup handling stations $S_1$ and $S_3$ are each provided with magazines for feeding the cover or cup from a respective stack. Stacks are delivered to the magazines by a feed arrangement as described with reference to FIGS. 1–9.

Figure 2:
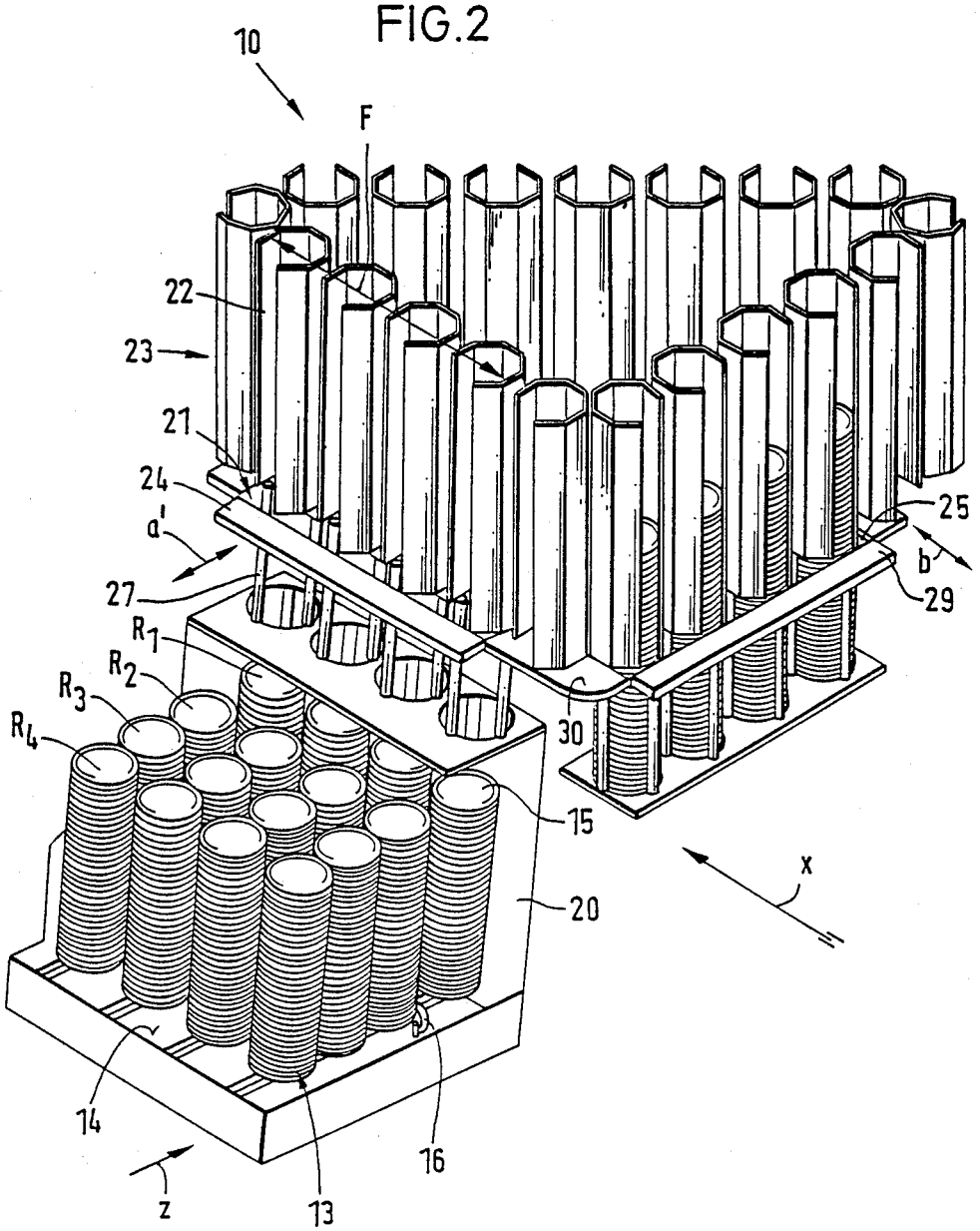
FIG. 2 is a similar perspective view of the devices shown in FIG. 1 in a second operating position.

In FIGS. 1 and 2 a cover feed device is indicated with the reference character 10 while the corresponding cup feed device of FIGS. 3 to 8 is indicated with the reference character I1.

An entire cup-filling apparatus for a comestible item, especially a dairy product, which is known, is not seen in FIGS. 1 and 2 while a partial side elevational view of the delivery side front end of a cup-filling apparatus is apparent in FIGS. 3 to 8 and is indicated with the reference character 12. A cup-filling apparatus, for example as can be used in combination with the indicated cover and/or cup feed devices 10,11, is illustrated in German Patent Open Application No. 26 45 904.

In all the FIGS. of the drawing comparable components—in so far as possible—are indicated with the same reference numbers.

In FIGS. 1 and 2 approximately column-like stacks of covers 13 are positioned on a slightly inclined feed surface 14. The individual covers are indicated with reference numbers 15. Sometimes four stacks of covers 13 form a row $R_1$–$R_4$ corresponding to the number of cover receptacle motion feed paths of the cup feed unit. In the present case a four path cup-filling apparatuses shown. The longitudinal and/or feed direction of the cup-filling apparatus not shown in FIGS. 1 and 2 is indicated at x.

The feed motion of the cover stacks 13 arranged in cover stack rows $R_1$–$R_4$ on the feed surface 14 occurs along the feed surface 14 inclined with an inclination angle a with respect to the machine frame surface with known means, for example by an unshown feed finger until at the pivotable rear retaining arm 16 located on the surface 14. This inwardly and outwardly pivotable rear retaining arm 16 restrains the feed of the rows $R_3$–$R_1$ and/or $R_4$–$R_2$ to permit an unimpeded feed motion along the axial direction y in an elevator 17.

The previously mentioned feed fingers (not shown) are located in the grooves 18 at whose ends (in direction z) a carrier 19 of the elevator 17 is provided to engage under a stack of covers 13.

At the end of the feed surface 14 (as observed in the direction z) a wall 20 is provided which is positioned at right angles to the feed surface 14 so that of course it is also inclined at an angle a to the vertical. From FIG. 2 it is apparent that the row $R_1$ meantime was fed further in the direction z in comparison to FIG. 1 and rests on the inclined wall 20. An additional cover stack row $R_4$ meantime could be mounted on the surface 14 following the others. From FIG. 2 it is also seen that now the cover stack row $R_2$ is prevented from further motion in the z direction by the rear retaining arm 16.

The further operation of the cover feed device 10 according to FIGS. 1 and 2 is as follows:

Each stack of covers 13 in the row $R_1$ according to FIG. 2 is engaged by an upwardly and downwardly movable carrier 19 of the elevator 17 projecting on one side in a direction opposite to the direction z.

With the aid of FIG.2 it is seen that the elevator 17 can lift the four stacks of covers 13 of the row $R_1$ with four carriers 19 from below through lower feed openings 21 of the shafts 22 of an intermediate magazine 23 so that subsequently an operating state analogous to FIG. 1 is achieved in which a row of cover stacks $R_0$ is located is provided in intermediate magazine 23 whose shafts 22 are arranged in rows in the filling position F along the feed direction x laterally beside the cup-filling apparatus of which only the cover delivery magazine 26 is illustrated.

As soon as the cover stack row $R_1$ is positioned in the shafts 22 of the intermediate magazine 23 a continuous strip like supporting base 24 engagable and disengagable in the direction of the double arrow a' engages on one side under the shaft 22 grasping the four cover stacks 13 of the row $R_1$ so that the elevator carrier 19 can be moved downwardly again. While the supporting base 24 in FIG. 2 is shown disengaged the supporting base 24 according to FIG. 1 is provided in its engaged condition grasping the cover stacks 13 of the row $R_0$ from below.

According to FIGS. 1 and 2 a plurality of individual magazine shafts 22 are provided which are positioned according to an isosceles triangle and are attached to an unshown roller chain or intermediate magazine chain (not shown) projecting exteriorly which circulates in a horizontal plane. In the present case a sprocket wheels (not shown) is provided on the corner points I, II and III each with a perpendicular or vertical rotation axis. The rotation direction of the intermediate magazine shafts is counterclockwise. With the aid of FIGS. 1 and 2 it can be seen that the arrangement contains three intermediate magazines 23. In this arrangement temporarily a magazine shaft 22 or several magazine shafts 22 are unoccupied between two successively located intermediate magazines.

Figure 9:
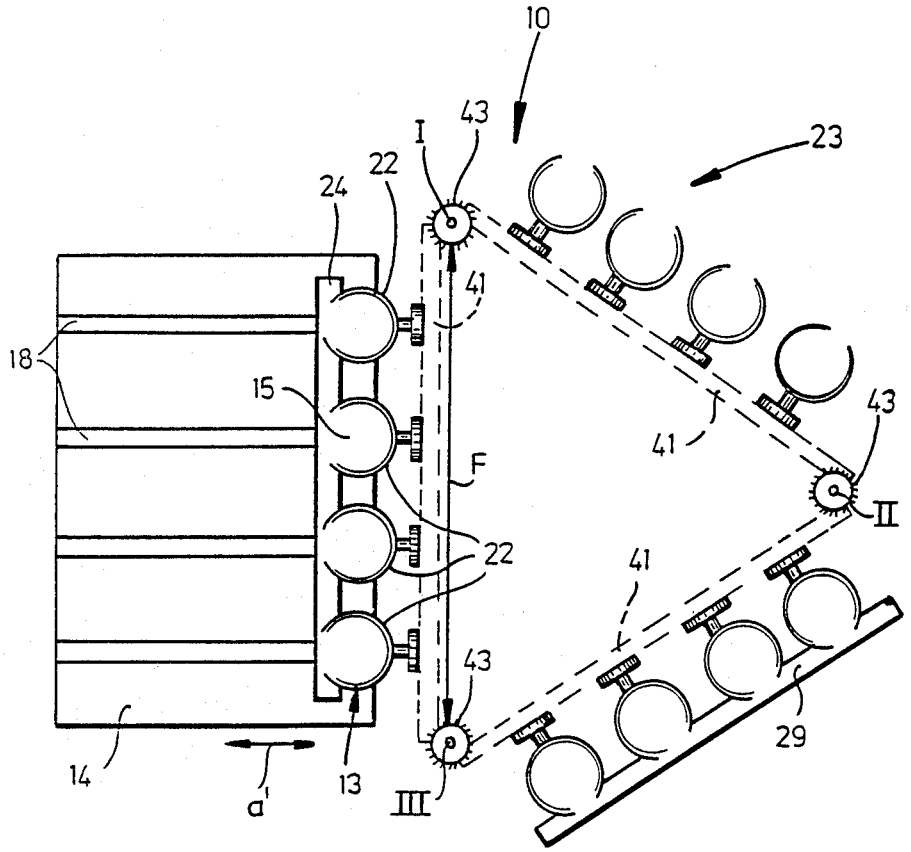
FIG. 9 is a top plan view of an alternative embodiment of the devices in the cup-filling apparatus shown in FIGS. 1 and 2.

An alternative embodiment of the cup and/or cover feed device is shown in FIG. 9. Although this feed device has three intermediate magazines as does the one described in the previous paragraph, they form an equilateral rather than isosceles triangle and are mounted on equal peripheral longitudinal portions of a circulating intermediate magazine chain 41 projecting exteriorly. This roller chain is driven by sprocket wheels 43 mounted at the corner points I,II and III coincident with the wheel vertical rotation axes. Also the same number of shafts 22 is provided in each intermediate magazine 23 as cup feed paths.

As soon as an intermediate magazine is filled in the filling position F and the strip like supporting base 23 engaged, the entire intermediate magazine chain moves counterclockwise a certain amount so that four lower openings 21 of the filled shafts 22 are aligned with the upper openings 25 of a cover delivery magazine 26 which is located above and/or adjacent to an unshown cover delivery station of the cap filling apparatus. This position of the intermediate magazine 23, the discharging position, is indicated at E.

Above the cover delivery magazine 26 which contains four individual magazine shafts 28 bounded by guide rods 27 a strip like supporting base 29 which is similar to the supporting base 24 and is engagable and disengagable in the direction of the the double-headed arrow b is provided. As soon as the magazine shaft 28 of the cover delivery magazine 26 is filled the strip like supporting base 29 is actuated so that the covers 15 in the magazine shaft can drop.

A rotation of the collective intermediate magazine shafts 22, i.e. a change of an intermediate magazine 23 from the filling position F to the discharging position E, occurs continuously on closing and/or engaging the strip like supporting bases 24 and 29. Thus the engaging supporting bases 24, 29 serve at the same time as a spatially holdable sliding surface engaged under the undersides of the cover stacks 13. The motion of the magazine shafts 22 occurs according to FIGS. 2 and 3 in a single horizontal plane.

From FIGS. 1 and 2 it is apparent moreover that to bridge a space between the filling position F and the discharging position E between the supporting bases 24,29 an immovable spatially fixed supporting and sliding surface 30 engaged under the cover stack 13 is provided.

In the cup feed devices shown in FIGS. 3 to 8 feed surface 14, rear retaining arm 16, elevator 17 with carrier 19 are arranged and positioned similar to the example according to FIGS. 1 and 2. However the motion of the intermediate magazine 23 according to FIGS. 3 to 8 with its magazine shafts 22 is not substantially linear and/or translatory but is located with a comparatively large pivot radius r about a pivot point D.

The intermediate magazine 23 according to FIGS. 3 to 8 pivots from its filling position F into its discharging position E above the cup delivery magazine 26.

Figure 3:
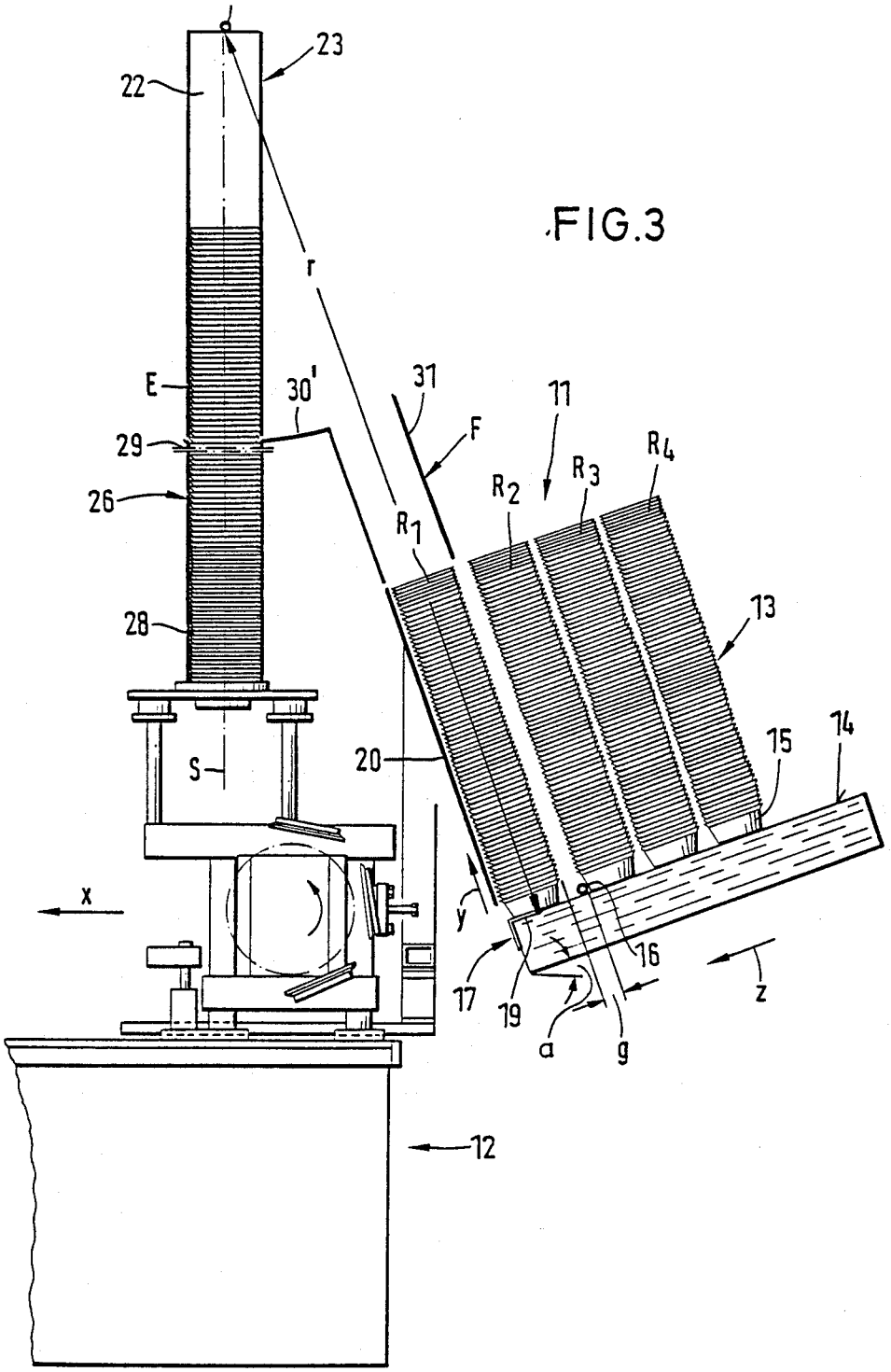
FIGS. 3 to 7 are side elevational views of a cup feed device at the front end portion of a cup-filling apparatus in different operating positions.

The operation of the cup feed device 11 according to FIGS. 3 to 8 is as follows:

According to FIG. 3 a cup stack 13 is provided with cups 15 inside of the foremost row $R_1$. A spacing g in the direction z is maintained between $R_1$ and $R_2$ so that the elevator 17 can be feed the row $R_1$ unhindered. The rear retaining arm 16 provides for this spacing g.

According to FIG. 3 the intermediate magazine 23 already is provided in its discharging position E,i.e. the supporting base 29 only indicated with a dashed line, which can be a slider, is disengagable so that the cups 15 can be moved downwardly in the shaft 28 of the cup delivery magazine 26.

Figure 4:
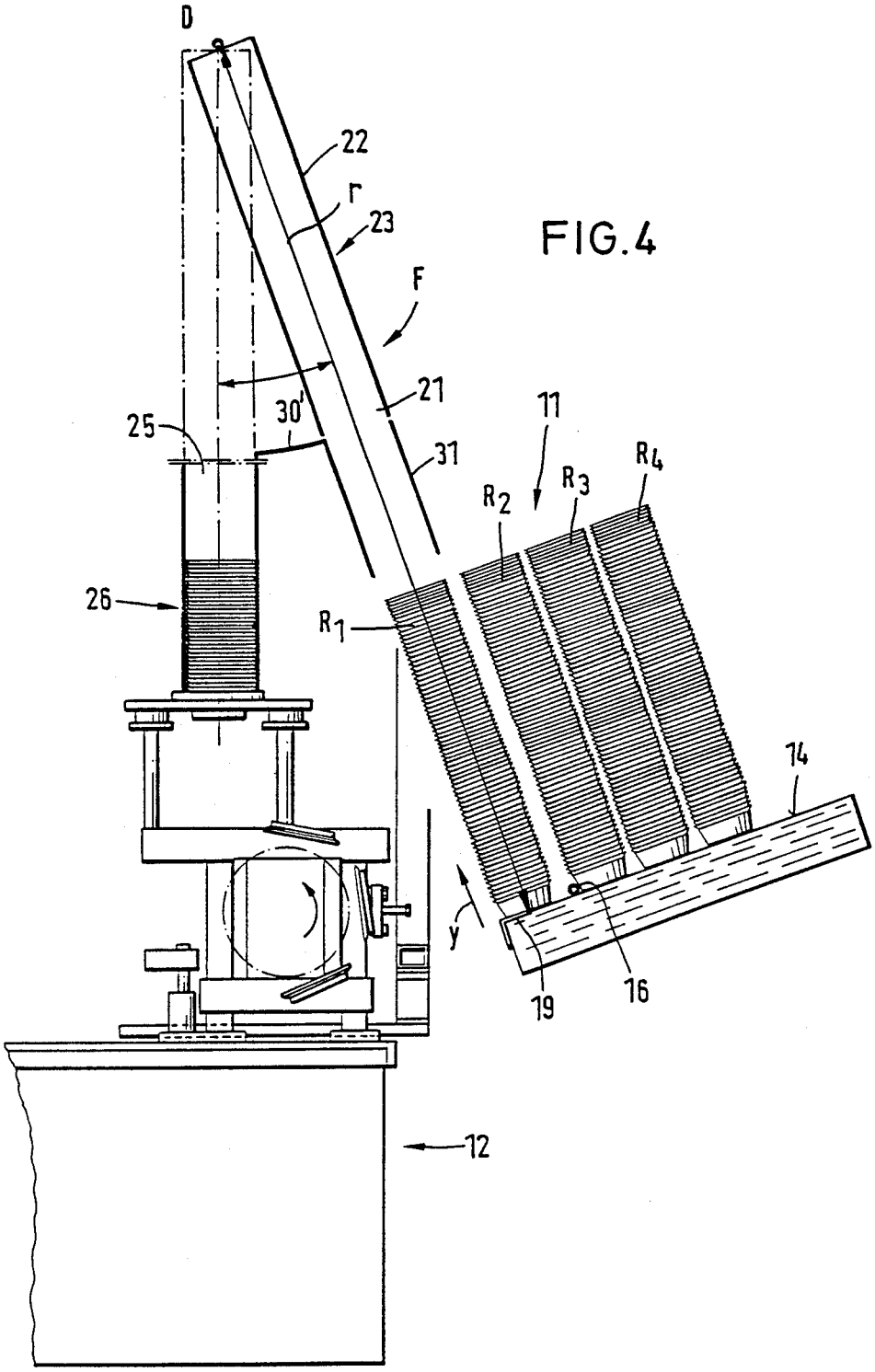

As soon as the cup level has gone below the supporting base 29 which for example is ascertainable by an optical control in a known way, the meantime empty intermediate magazine which contains four magazine shafts 22 in a four path cup-filling apparatus, can swing right into the filling position F according to FIG. 4. Here the elevator 17 has the opportunity to travel up with its carrier 19 protruding like a finger in the direction y.

Figure 5:
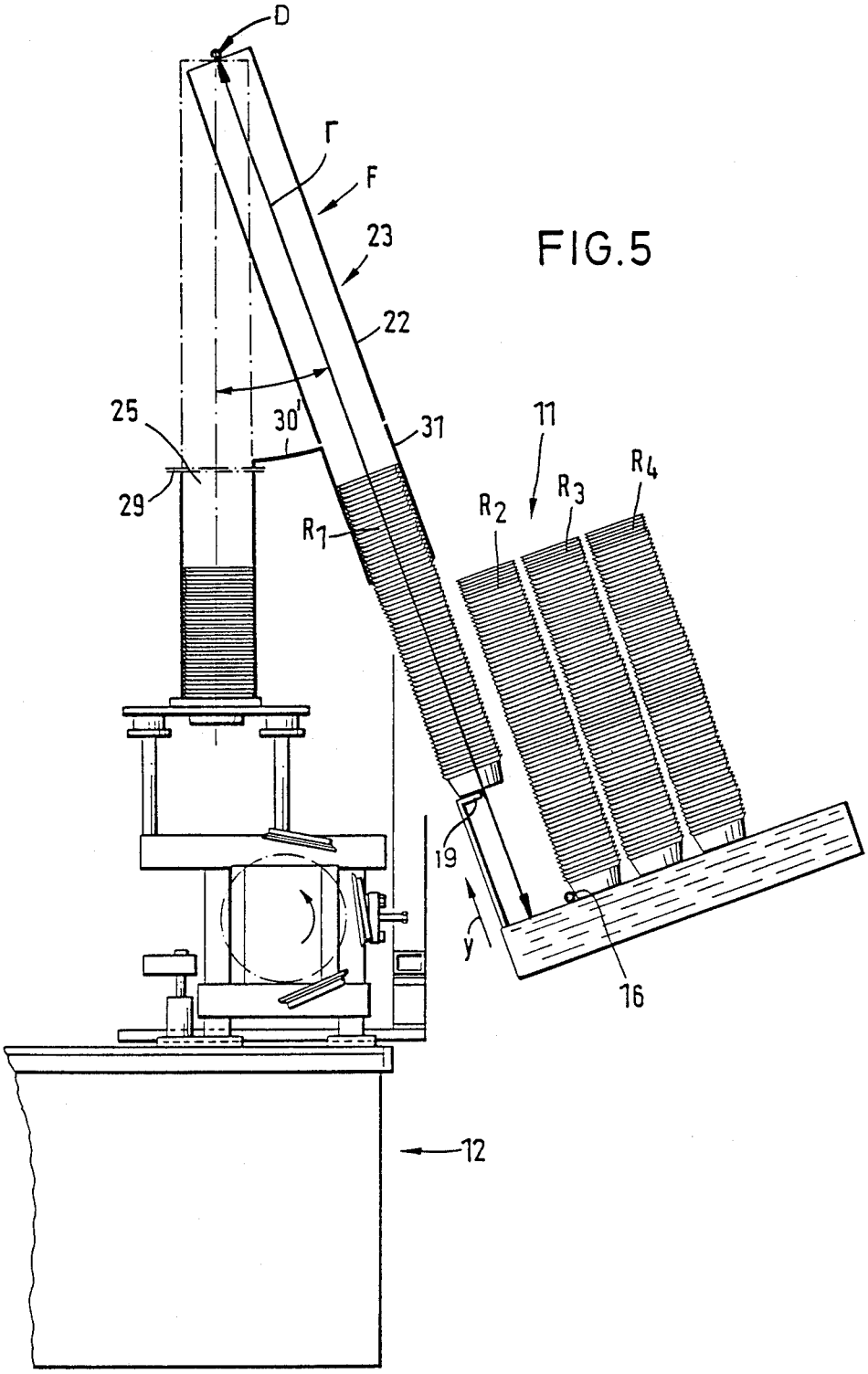

The row $R_1$ arrives in the intermediate magazine 23 because of an intermediate guide member 31 (analogous to the bounding guide rods 27 in FIGS. 1 and 2). A related intermediate stage is shown in FIG. 5.

Figure 6:
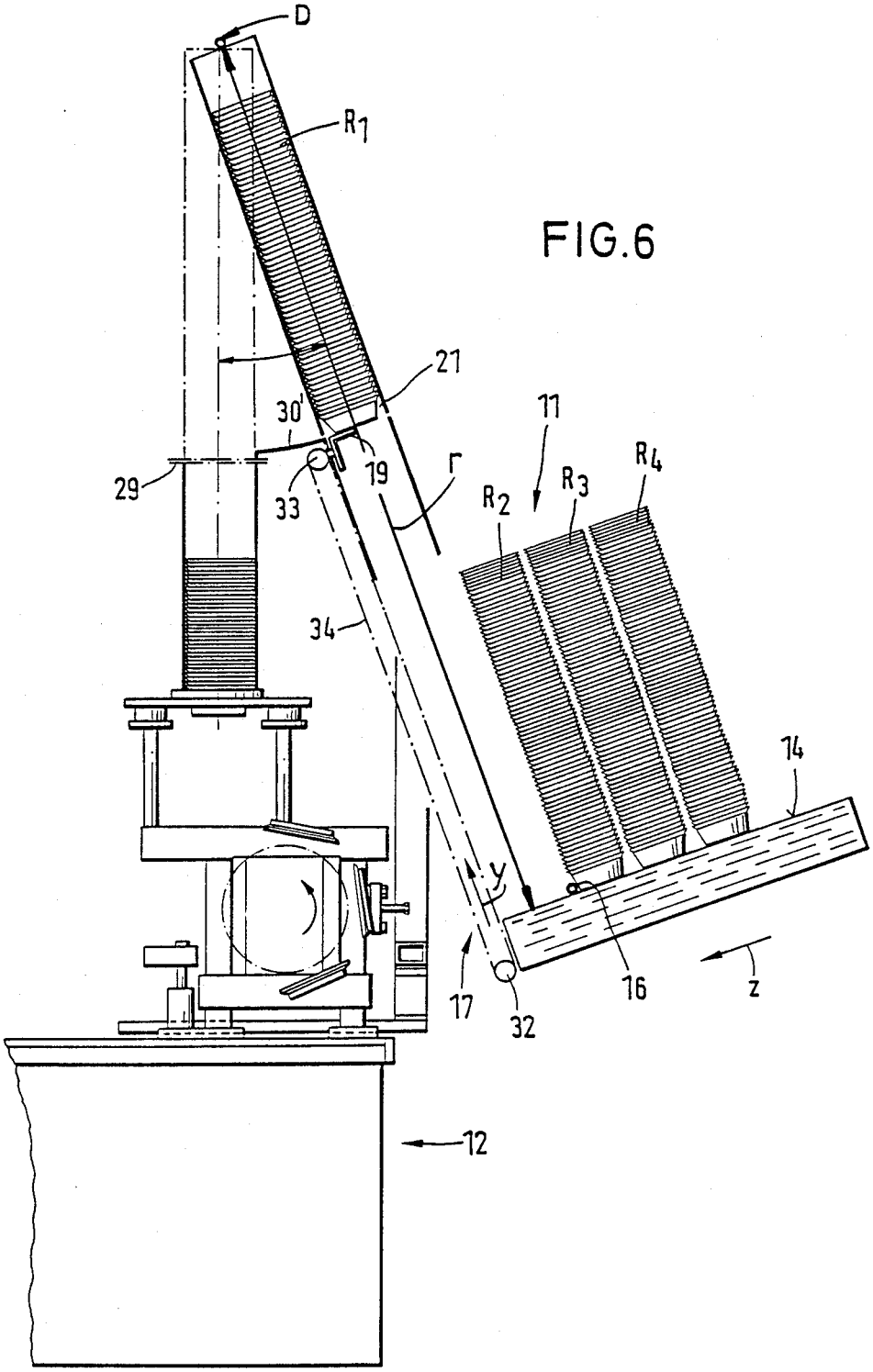
Figure 7:
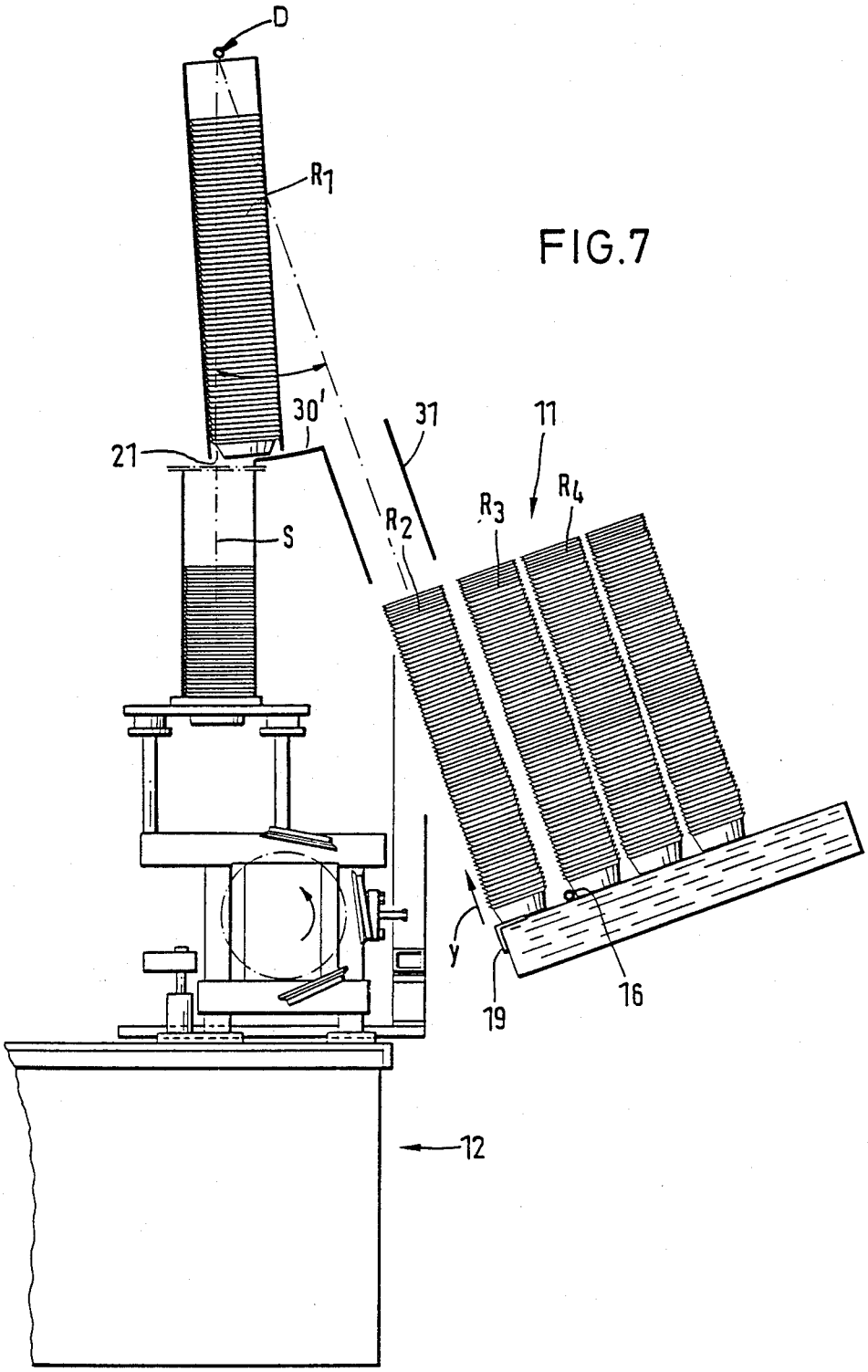

According to FIG. 6 the elevator carrier 19 finally attains its highest position so that the intermediate magazine 23 can swing to the left into its discharging position E (FIG. 3) by a spatially fixed immovable supporting or sliding base formed by bridging sliding surface 30'.

The bridging sliding surface 30' is concave according to a circumferential arc of radius r.

Only in FIG. 6—taking the place of FIGS. 3 to 5, 7 and 8—is it schematically illustrated that the elevator 17 is a chain elevator with elevator chains 34 on both sides of the feed surface 14 which runs over circulating sprocket wheels 32, 33. In this case the elevator carrier 19 could be attached to the strand of the elevator chain 34 adjacent the cups 13.

Figure 8:
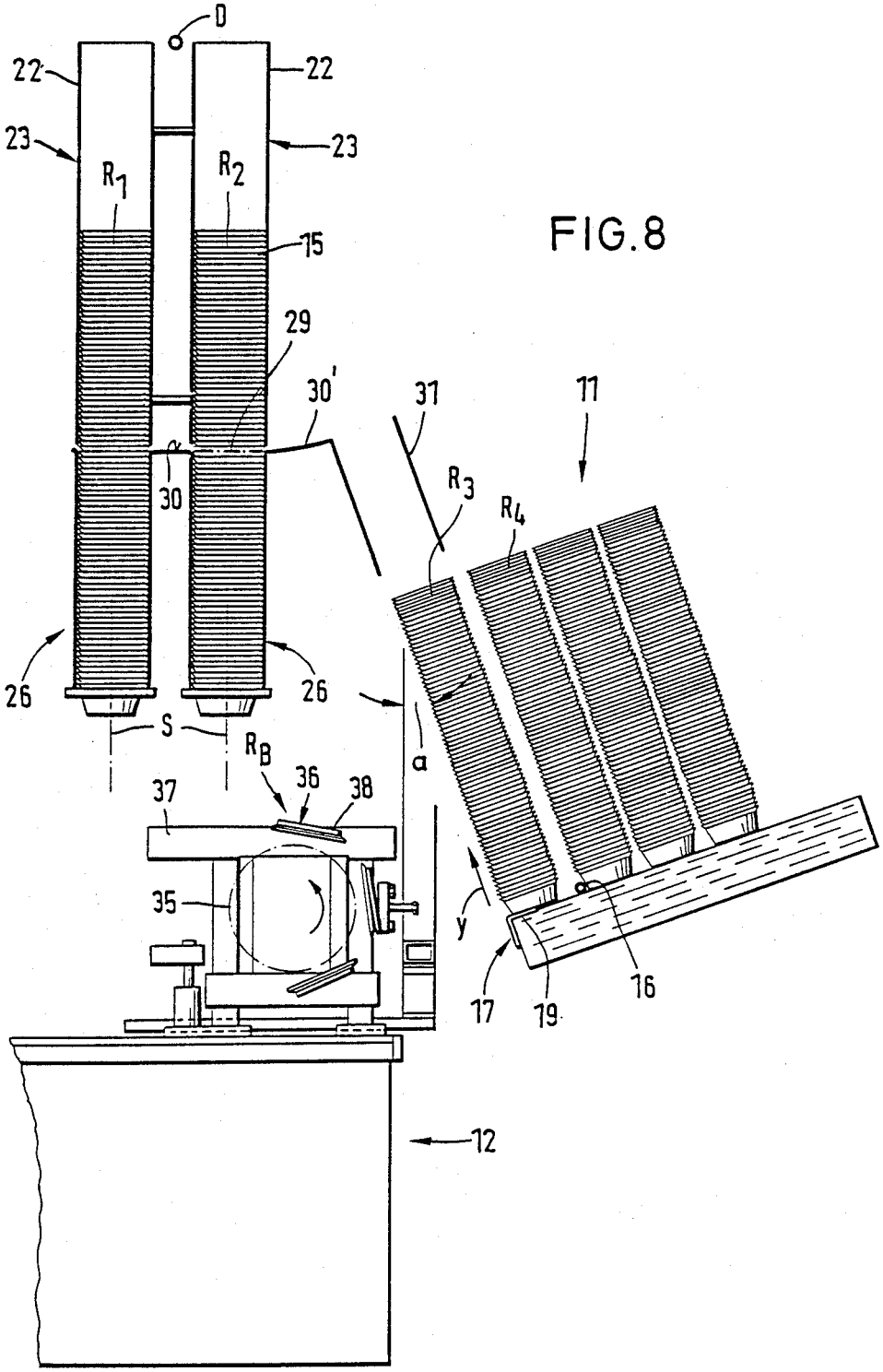
FIG. 8 is a side elevational view showing another form of our invention, namely a double step cup feed unit otherwise similar to that shown in FIG. 3.

A modified embodiment is shown in FIG. 8 where namely in a double step cup feed machine—observed in the feed direction x—double work stations are provided—as a result also a double cup delivery magazine 26, 26.

The cup feed device 11 is correspondingly fitted and thus double rowed with two intermediate magazines 23 equipped with four magazine shafts 22 each. In this arrangement only one engagable and disengagable supporting base 29 is provided above the cup delivery magazine 26 shown in FIG. 8.

Between the cup delivery magazines 26, 26 an additional bridging sliding surface 30' is located similar to bridging sliding surface 30' between intermediate guide member 31 and the cup delivery magazine 26 shown on the right in FIG. 8. This bridging sliding surface 30' forms an additional immovable spatially fixed sliding or supporting base.

In the embodiment of FIG. 8 both intermediate magazine rows 23, 23 are filled successively by the elevator 17, i.e. first the magazine 23 to the left in FIG. 8 is filled and then after an partial pivoting the right intermediate magazine 23 shown right in FIG. 8 is filled. As soon as the position according to FIG. 8 is attained the cups 15 located in the left intermediate magazine 26 in the associated cup delivery magazine 26 drop. Next the supporting base 29 (e.g. a slider) must be disengaged for emptying of, i.e. opening, the right adjacent intermediate magazine 23.

Additionally it should be indicated that the motion of the intermediate magazine 23 corresponding to the examples 1 to 8 is motor driven, if necessary by the cyclic motion of the cup-filling apparatus.

In regard to the cup-filling apparatus 12 the following should be mentioned in addition:

In FIGS. 3 to 8 the delivery side front end of the cup-filling apparatus 12 is only partially and schematically shown. As an.essential component of the cup-filling apparatus 12 only one revolving sprocket wheels 35 is partially shown which carries cell panel 36 oriented transverse to the feed direction x on a circulating guided chain 37. The cell panels 36 contains the cup receptacles 38 shown likewise only schematically.

The rows of cup receptacles 38 (cup receiving rows) extending into the paper plane according to FIGS. 3 to 8 are indicated with $R_B$.

The stack axes of the cup delivery magazines 26 is indicated with S.

The leaning wall inclined at an angle a to the vertical for the cup rows is—instead of in the balance of the drawing—only shown in FIG. 3.

By definition the revolving sprocket wheels 35, the cell panel 36 and the circulating guided chain 37 comprises the revolving feed means of the cup-filling apparatus.

We claim:

1. In a cup-filling apparatus for a comestible item, especially a dairy product, comprising a revolving feed means which carries a plurality of cup receptacles positioned in rows transverse to the feed direction which also are alignable along a plurality of cup feed paths parallel to the feed direction and also comprising a plurality of aligned workstations including a cup feed station, a cover mounting station, a closing station and a cup removing station operating in temporally equal feed cycles in succession in which a plurality of column-like cup stacks along said cup-feed paths simultaneously are fed to a plurality of shafts of a main cup delilvery magazine in said cup feed station, the improvement wherein an elevator is provided for feeding said cup stacks and has a carrier which engages under at least two adjacent of said cup stacks and lifts said two of said cup stacks from below axially into a lower opening of one of shafts of an intermediate cup magazine, said lower openings being associated with an engageable and disengageable supporting base for retaining said two cup stacks, said intermediate magazine being movable and displaceable from a filling position to a discharging position in which each lower opening registers with an upper opening of the shafts of the main cup delivery magazine positioned above said cup feed station, said intermediate magazine being displaceable from said filling position which extends parallel to said cup feed path into said discharging position which lies parallel to said cup receptacle rows and above said cup delivery magazine, said supporting base simultaneously forming a spatially holdable sliding surface for the underside of said cup stack during motion of a filled one of said intermediate magazines from said filling position to said discharging position.

2. In a cup-filling apparatus for a comestible item, especially a dairy product, comprising a revolving feed means which carries a plurality of cup receptacles positioned in rows transverse to the feed direction which also are alignable along a plurality of cup feed paths parallel to the feed direction and also comprising a plurality of aligned workstations including a cup of feed station, a cover mounting station, a closing station and a cup removing station operating in temporally equal feed cycles in succession in which a plurality of column-like cup stacks along said cup-feed paths simultaneously are fed to a plurality of shafts of a main cup delivery magazine in said cup feed station the improvement wherein an elevator is provided for feeding said cup stacks and has a carrier which engages under at least two adjacent of said cup stacks and lifts said one of said cup stacks from below axially into two lower openings openings of two shafts of an intermediate cup magazine, said lower openings being associated with an engageable and disengageable supporting base for retaining said two cup stacks, said intermediate magazine being movable and displaceable form a filling position to a discharging position in which each lower opening registers with an upper opening of the shafts of the main cup delivery magazine positioned above said cup feed station, said intermediate magazine being displaceable from said filling position which extends parallel to said cup feed path into said discharging position which lies parallel to said cup receptacle rows and above said cup delivery magazine, said shafts of said intermediate magazine being attached projecting laterally exteriorly to a circulating intermediate magazine chain driven about a plurality of substantially vertical rotation axes.

3. The improvement according to claim 2 wherein said circulating intermediate magazine chain is arranged to form a plurality of equal longitudinal peripheral portions which carry the same number of said magazine shafts as the number of said cup feed paths.

4. In a cup-filling apparatus for a comestible item, especially a dairy product, comprising a revolving feed means which carries a plurality of cup receptacles positioned in rows transverse to the feed direction which also are alignable along a plurality of cup feed paths parallel to the feed direction and also comprising a plurality of aligned workstations including a cup feed station, a cover mounting station, a closing station and a cup removing station operating in temporary equal fed cycles in succession in which a plurality of column-like cup stacks along said cup-feed paths simultaneously are fed to a plurality of shafts of a main cup delivery magazine in said cup feed station, the improvement wherein an elevator is provided for feeding said cup stacks and has a carrier which engages under at least two adjacent of said cup stacks and lifts said one of said cup stacks from below axially into two lower openings of two shafts of an intermediate cup magazine, said lower openings being associated with an engageable and disengageable supporting base for retaining said two cup stacks, said intermediate magazine being movable and displaceable form a filling position to a discharging position in which each lower opening registers with an upper opening of the shafts of the main cup delivery magazine positioned above said cup feed station, said intermediate magazine being displaceable form said filling position which extends parallel to said cup feed path into said discharging position which lies parallel to said cup receptacle rows and above said delivery magazine, and wherein for feeding said cup stacks, said elevator with said carrier is located on a long side of said cup-filling apparatus and said intermediate magazine is displaceable from said filling position alongside said cup-filling apparatus into said discharging position extending at right angles to said cup feed path above said cup feed station.

* * * * *